United States Patent [19]

Inoue et al.

[11] 3,977,922

[45] Aug. 31, 1976

[54] CAPSULATED EXPLOSIVE COMPOSITIONS

[75] Inventors: Kazuhiro Inoue, Chita; Hiroshi Sato, Susono; Fumio Matsui, Chita, all of Japan

[73] Assignee: Nippon Oils and Fats Company Limited, Tokyo, Japan

[22] Filed: Sept. 4, 1973

[21] Appl. No.: 393,979

[30] Foreign Application Priority Data

Sept. 9, 1972 Japan ..... 47-90572

[52] U.S. Cl. ..... 149/2; 149/88; 149/89; 149/101; 149/105; 149/110

[51] Int. Cl.[2] ..... C06B 45/00

[58] Field of Search ..... 149/2, 3, 11, 14

[56] References Cited

UNITED STATES PATENTS

| | | | |
|---|---|---|---|
| 3,375,147 | 3/1968 | Sparks et al. | 149/2 X |
| 3,395,055 | 7/1968 | Sparks et al. | 149/2 X |
| 3,462,324 | 8/1969 | Grant et al. | 149/2 |
| 3,713,915 | 1/1973 | Fast | 149/2 |
| 3,794,534 | 2/1974 | Chandler | 149/2 |

*Primary Examiner*—Stephen J. Lechert, Jr.
*Attorney, Agent, or Firm*—Stevens, Davis, Miller & Mosher

[57] ABSTRACT

A capsulated explosive composition comprising a high molecular weight compound forming the capsule wall and an explosive forming the core is high in power and low in sensitivity and vapor pressure, and can be easily handled.

6 Claims, No Drawings

CAPSULATED EXPLOSIVE COMPOSITIONS

The present invention relates to micro-capsulated explosive compositions.

More particularly, the present invention relates to explosive compositions obtained by micro-capsulating explosive liquid compounds, such as glycerine trinitrate, ethylene glycol dinitrate and the like, or gelatinized products of these compounds with nitrocellulose with high molecular weight compounds, such as polyurethane, polyurea and the like.

It was difficult to use explosive liquid compounds alone, such as glycerine trinitrate, ethylene glycol dinitrate and the like, because they have a high power and a high sensitivity to impact and friction. In order to prevent these drawbacks, A. Nobel developed the guhr dynamite in the year of 1866 by absorbing glycerine trinitrate in kieselguhr, the high power blasting gelatine in the year of 1875 by absorbing glycerine trinitrate in nitrocellulose, the low freezing dynamite in the year of 1876 by using a mixture of glycerine trinitrate and ethylene glycol dinitrate, and the ammon gelatine dynamite in the year of 1879 by using ammonium nitrate.

In these methods, glycerine trinitrate, ethylene glycol dinitrate and the like are absorbed in a solid substance in order to produce explosives which can be handled safely.

The object of the present invention is to provide an explosive composition, which has an excellent stability and can be easily handled, by fixing an explosive liquid compound or a gelatinized product thereof in a method different from the above described methods.

The inventors have found that when an explosive liquid compound or a gelatinized product thereof is micro-capsulated with a high molecular weight compound, the explosive liquid compound is fixed and an explosive composition, which has a low sensitivity and a high chemical stability and can be easily handled, can be obtained.

The micro-capsulation method has already been applied widely to the field of pressure-sensitive copying papers, magnetic recording materials, medicines, pesticides, fertilizers and the like, but has not hitherto been applied to the explosives, particularly to the explosive liquid compounds or the gelatinized products thereof. Of course, the industrial production of micro-capsulated explosive compositions has never been attempted.

According to the present invention, a micro-capsulated explosive composition can be easily obtained by micro-capsulating and fixing a dangerous explosive, and therefore the micro-capsulated explosive composition is an epoch-making explosive composition. Moreover, due to the excellent property and the favorable form, the micro-capsulated explosive composition of the present invention provides new uses which have never been anticipated.

As the explosive liquid compounds to be used for the production of micro-capsules of the present invention, mention may be made of glycerine trinitrate, glycerine dinitrate, ethylene glycol dinitrate, diethylene glycol dinitrate, triethylene glycol dinitrate, trimethylene glycol dinitrate, diglycerine tetranitrate, monochlorohydrin dinitrate, acetylglycerine dinitrate, 1,2,3-butanetriol trinitrate, 2-nitro-2-oxymethyl-1,3-propanediol trinitrate, 2-methyl-2-oxymethyl-1,3-propanediol trinitrate, nitrobenzene, tetranitromethane and the like, and mixtures thereof.

Further, gelatinized products of the above described explosive liquid compounds with gelatinizing agents, such as nitrocellulose and the like, for example, gelatinized products obtained by absorbing glycerine trinitrate, glycerine dinitrate, ethylene glycol dinitrate and the like in nitrocellulose can be used for the production of micro-capsules of the present invention.

As the high molecular weight compounds to be used for the production of micro-capsules of the present invention, mention may be made of thermosetting resins, such as polyurethane, polyurea, epoxy resin and the like, and thermoplastic resins, such as polystyrene, polyvinyl alcohol and the like.

The micro-capsules of the present invention are produced in the following manner. An explosive liquid compound is dispersed in water together with methylcellulose, a surfactant and the like, monomer of a high molecular weight compound, which forms the capsule wall, is added to the dispersed system, and, if necessary, a polymerization initiator or a reactive monomer is added thereto, and the resulting mixture is subjected to a polymerization reaction.

According to the above described method, it is possible to produce micro-capsules containing an explosive liquid compound in an amount as large as about 80-95% by weight.

The micro-capsules produced by the above described method have the following excellent properties.

1. The power is high.
2. The sensitivity is low.
3. The vapor pressure is low. Moreover, since the micro-capsules are solid, they can be easily handled in transportation and weighing.

The micro-capsules are particularly useful as a propellant for small arms or artilleries, a propellant for rockets and a high explosive for special use.

That is, in the conventional explosives, the upper limit of the mixing ratio of explosive liquid compound-/solid substance is about 50/50 (by weight). While when the micro-capsulated explosive composition of the present invention is mixed with other solid materials to produce explosives, it is possible to produce explosives containing an explosive liquid compound in a mixing ratio of the explosive liquid compound/solid substance of as high as 80/20-95/5 (by weight). Therefore, propellants for small arms or artilleries, propellants for rocket and high explosives having a higher power can be produced.

In general, when glycerine trinitrate, ethylene glycol dinitrate and the like are mixed with other materials to produce explosives, the mixing step is always attended with danger. On the contrary, when the micro-capsulated explosive composition of the present invention is mixed with other materials to produce explosives, since the explosive liquid compound is protected by the safe high molecular weight compound capsule wall, the explosives can be safely produced without danger.

As described above, the micro-capsulated explosive composition of the present invention can be advantageously used together with other materials. However, the composition itself can be used as a propellant for small arms and artilleries and a propellant for rocket.

Moreover, the composition has a particular use as a high explosive. For example, the composition is used in subaqueous blasting and in the blasting in the development of towns and cities, and further can be applied to various ammunitions and explosive devices. Therefore, the micro-capsulated explosive composition of the present invention is very valuable for industrial use.

The following examples are given for the purpose of illustration of this invention and are not intended as limitations thereof. In the examples, "part" means part by weight.

Further, in the examples, the drop hammer sensitivity test, the heat resistance test (65°C) and the ballistic mortar test were carried out following to the testing method described in JIS K4818-1968, "Test Method of Performances of Explosives".

Example 1

After 40 parts of glycerine trinitrate was dispersed in 100 parts of an aqueous solution containing 0.1 part of methylcellulose, a mixture of 6.4 parts of toluene diisocyanate and 10 parts of xylene was added to the disperse system and the resulting mixture was stirred at room temperature. After the mixture was formed into an emulsion, 4 parts of diethylene glycol was added thereto, and the stirring was further continued for 4–5 hours to effect a reaction and to form capsules having a grain size of about 300 $\mu$. The thus formed capsules were washed with water and then dried.

The results of the sensitivity test and stability test of the resulting capsules were as follows.

| | |
|---|---|
| Drop hammer sensitivity | 8th grade (The dropping height of a hammer, which causes one time of explosion in six times of drops of the hammer, is not lower than 50 cm.) |
| Heat resistance (65°C) | longer than 50 min. |
| Ignition point | 240°C |

When a ballistic mortar test of the capsules was effected in order to test the power, the capsules had a power as the 140 based on 100 of power of TNT.

Example 2

After 40 parts of ethylene glycol dinitrate was dispersed in 100 parts of an aqueous solution containing 0.1 part of methylcellulose, a mixture of 5 parts of 1,5-naphthalene diisocyanate and 5 parts of xylene was added to the disperse system and the resulting mixture was stirred at room temperature. After the mixture was formed into an emulsion, 3 parts of ethylene glycol was added thereto, and the stirring was further continued for 4–5 hours to effect a reaction and to form fine granular capsules. The thus formed capsules were washed with water and dried.

Properties of the resulting capsules were as follows.

| | |
|---|---|
| Drop hammer sensitivity | 8th grade (same as described in Example 1) |
| Heat resistance (65°C) | longer than 50 min. |
| Vapor pressure (25°C) | 0.0001 mmHg. |

Example 3

After 24 parts of glycerine trinitrate and 16 parts of ethylene glycol dinitrate were dispersed in 100 parts of an aqueous solution containing 0.1 part of methylcellulose, a mixture of 6.4 parts of toluene diisocyanate and 5 parts of xylene was added to the disperse system, and the resulting mixture was stirred at room temperature. After the mixture was formed into an emulsion, 7.6 parts of diethylenetriamine was added thereto, and the stirring was further continued for 4-5 hours to effect a reaction and to form fine granular capsules. The thus formed capsules were washed with water and dried.

Properties of the resulting capsules were as follows.

| | |
|---|---|
| Drop hammer sensitivity | 8th grade (same as described in Example 1) |
| Heat resistance (65°C) | longer than 50 min. |

For comparison, glycerine trinitrate was tested. It had a drop hammer sensitivity of 2nd-3rd grade and a heat resistance (65°C) of 20 minutes.

The 2nd grade drop hammer resistance is defined as follows. The dropping height of a hammer, which causes one time of explosion in six times of drops of the hammer, is between the range of not lower than 5 cm and lower than 10 cm.

The 3rd grade drop hammer resistance is defined as follows. The dropping height of a hammer, which causes one time of explosion in six times of drops of the hammer, is between the range of from not lower than 10 cm and lower than 15 cm.

Example 4

After a mixture of 40 parts of glycerine trinitrate and 0.1 part of nitrocellulose was dispersed in 100 parts of an aqueous solution containing 0.1 part of methylcellulose, 6.4 parts of toluene diisocyanate was added thereto, and the resulting mixture was stirred at room temperature. After the mixture was formed into an emulsion, 4 parts of diethylene glycol was added thereto, and the stirring was further continued to form fine granular capsules. The thus formed capsules were washed with water and dried.

Properties of the resulting capsules were as follows.

| | |
|---|---|
| Drop hammer sensitivity | 8th grade (same as described in Example 1) |
| Heat resistance (65°C) | longer than 50 min. |

Example 5

A mixture of 40 parts of 2-nitro-2-oxymethyl-1,3-propanediol trinitrate and 10 parts of styrene was added to 100 parts of an aqueous solution containing 0.1 part of methylcellulose, and the resulting mixture was stirred at room temperature. After the mixture was formed into an emulsion, 0.1 part of cobalt naphthenate and 1 part of methyl ethyl ketone peroxide were added thereto, and the stirring was further continued at room temperature to form capsules. The thus formed capsules were washed with water and dried.

Properties of the resulting capsules were as follows.

| | |
|---|---|
| Drop hammer sensitivity | 8th grade (same as described in Example 1) |
| Heat resistance (65°C) | longer than 50 min. |

What is claimed is:

1. A microencapsulated explosive composition consisting of a high molecular weight compound forming the capsule wall and at least one explosive liquid compound selected from the group consisting of glycerine trinitrate, glycerine dinitrate, ethylene glycol dinitrate, diethylene glycol dinitrate, triethylene glycol dinitrate, trimethylene glycol dinitrate, diglycerine tetranitrate, monochlorohydrin dinitrate, acetylglycerine dinitrate, 1,2,3-butanetriol trinitrate, 2-nitro-2-oxymethyl-1,3-propanediol trinitrate, 2-methyl-2- oxymethyl-1,3-propanediol trinitrate, nitrobenzene and tetranitromethane, forming the core.

2. The explosive composition as claimed in claim 1, wherein said explosive consists of a gelatinized product of the explosive liquid compound with nitrocellulose.

3. The explosive composition as claimed in claim 1, wherein the amount of said explosive is 80—95% by weight based on the total weight of the composition.

4. The explosive composition as claimed in claim 1, wherein said high molecular compound is a thermosetting resin selected from the group consisting of polyurethane, polyurea and epoxy resin.

5. The explosive composition as claimed in claim 1, wherein said high molecular compound is a thermoplastic resin selected from the group consisting of polystyrene and polyvinyl alcohol.

6. The explosive composition of claim 1, wherein fine granular capsules thereof are of a size of about 300$\mu$.

* * * * *